US005607822A

United States Patent [19]

Deguchi

[11] Patent Number: 5,607,822

[45] Date of Patent: Mar. 4, 1997

[54] PHOTOGRAPHIC COLOR-DEVELOPING CHEMICALS IN THE FORM OF GRANULES

[75] Inventor: Takashi Deguchi, Hino, Japan

[73] Assignee: Konica Corporation, Tokyo, Japan

[21] Appl. No.: 642,799

[22] Filed: May 3, 1996

Related U.S. Application Data

[63] Continuation of Ser. No. 432,509, May 1, 1995.

[30] Foreign Application Priority Data

May 9, 1994 [JP] Japan ..... 6-095159
Jun. 28, 1994 [JP] Japan ..... 6-146682

[51] Int. Cl.[6] ..... G03C 7/413

[52] U.S. Cl. ..... 430/465; 430/433; 430/486; 430/490

[58] Field of Search ..... 430/433, 465, 430/486, 490

[56] References Cited

U.S. PATENT DOCUMENTS

| | | | |
|---|---|---|---|
| 4,252,892 | 2/1981 | Case | 430/433 |
| 4,816,384 | 3/1989 | Fruge et al. | 430/465 |
| 4,923,786 | 5/1990 | Kuhner et al. | 430/465 |
| 5,135,840 | 8/1992 | Reuter et al. | 430/465 |
| 5,204,229 | 4/1993 | Nakamura et al. | 430/433 |
| 5,278,036 | 1/1994 | Kobayashi et al. | 430/465 |
| 5,336,588 | 8/1994 | Ueda | 430/465 |
| 5,362,610 | 11/1994 | Yoshimoto | 430/465 |
| 5,409,805 | 4/1995 | Haraguchi et al. | 430/465 |
| 5,457,010 | 10/1995 | Satake et al. | 430/465 |

FOREIGN PATENT DOCUMENTS

| | | |
|---|---|---|
| 0411513A1 | 2/1991 | European Pat. Off. . |
| 0589624A1 | 3/1994 | European Pat. Off. . |
| 0678782A1 | 10/1995 | European Pat. Off. . |

*Primary Examiner*—Hoa Van Le
*Attorney, Agent, or Firm*—Frishauf, Holtz, Goodman, Langer & Chick, P.C.

[57] ABSTRACT

Color developing chemicals in the form of granules for a silver halide color photographic material containing a p-phenylenediamine compound, wherein the color developing chemicals further contain a compound represented by the following formula, the chemicals imparting a pH of 5.0 or less to an aqueous solution in which the chemicals are dissolved Formula

9 Claims, No Drawings

PHOTOGRAPHIC COLOR-DEVELOPING CHEMICALS IN THE FORM OF GRANULES

This application is a continuation, of application Ser. No. 08/432,509, filed May 1, 1995.

FIELD OF THE INVENTION

This invention relates to a solid color-developing chemical for silver halide color photographic light-sensitive material and, particularly, to a color-developing chemical granule for silver halide photographic light-sensitive material in which the stability in storage is improved, to the process of granulating the granule, and to solid processing chemicals and a tablet-shaped solid processing chemical each applied with the granule.

DESCRIPTION OF THE PRIOR ART

In recent years, the techniques of solidifying a photographic processing chemical into a granular or tablet shape are disclosed in, for example, Japanese Patent Publication Open to Public Inspection (hereinafter referred to as JP OPI Publication) Nos. 51-61837/1976, 2-109043/1990, 6-3787/1994 and 6-35130/1994.

The above-mentioned JP OPI Publication No. 51-618375/1976 discloses solid processing chemicals prepared by mixing a paraphenylenediamine type compound, a sulfite and a hydroxyl amine sulfate and then by molding the resulting mixture into the tablet shape. However, the above-mentioned solid processing chemicals are prepared by simply mixing the components thereof. Therefore, even if the chemicals are tightly packed in a fully moisture-proof packaging material, the following new problem was raised in a high temperature and a high humidity area such as Southeast Asia. The above-mentioned chemicals are tinted when unsealed for making use of it and then put in an automatic processor, or when kept allowing to stand after it is unsealed. As the result, such a problem is raised that the users may feel uneasy on whether the solid shaped chemical may be deteriorated.

JP OPI Publication No. 2-109043/1990 discloses a granular-shaped developing agent having an average particle-size of 150 μm or larger and a deviation within such a range that 80% of the particles have a particle-size deviation not exceeding ±100 μmn of a desired particle-size, a granular-shaped antioxidant, and a color photographic developing agent prepared by mixing a granular-shaped alkali agent therein. The patent publication also describes that the photographic developing agent has an infinitive durability and an excellent solubility.

It is no doubt that a considerable preservability can be enjoyed, provided that a chemical is moisture-proof packed. However, when the drying temperature is raised in order to shorten the drying time in the process of preparing the chemicals, there arisen problems requiring that a means for drying the chemicals with an inert gas is required such as nitrogen gas, that the productivity is lowered, and that the large-scaled production facilities are required. Further, when the moisture-proof is not satisfactory, there raises such a problem that a color tint is produced under the high temperature and high humidity conditions.

JP OPI Publication Nos. 6-3787/1994 and 6-35130/1994 disclose the solid processing chemicals each granulated after mixing a paraphenylenediamine type compound and a hydroxyl amine derivative. According to the processes, a solubility, a tablet strength obtained when tableting it, and an antisolubility in storage may be assured. However, such a problem was found out that a color tint is produced under the high temperature and high humidity conditions.

The solid processing chemicals prepared in any one of the above-mentioned preparation processes were newly proved to have such a defect that the content of a paraphenylenediamine type compound is reduced after completing the preparation, when scaled up or when a drying temperature is so raised as to improve a drying efficiency.

After repeating the studies on solid processing chemicals for color-developing use containing a paraphenylene-diamine type compound, the present inventors have discovered to obtain a color-developing agent granule, the process for granulating the same, and a tablet-type processing chemical for color-developing use, wherein any deterioration can be prevented in the courses of preparing the chemical, without tinting any color even under the conditions of a high temperature and a high humidity and even if a drying treatment is carried out at a further higher temperature, by making use of a compound represented by Formula [A] in the solid processing chemical for color-development use and then by controlling the pH to be not higher than 5.0 when the granule is dissolved in water.

SUMMARY OF THE INVENTION

It is, therefore, an object of the invention to provide a stable granule for color-development use in which any color-tint can be prevented under the conditions of a high temperature and a high humidity.

Another object of the invention is to provide a granule for color-development use in which any deterioration can be prevented in the courses of preparing the same.

These and other objects of the invention will become apparent from the following detailed descriptions.

The above-mentioned problems have been discovered to be solved in the following means.

Color-developing chemicals in the form of granules for silver halide color photographic light-sensitive material, which contains at least one of paraphenylenediamine type compounds; wherein at least a part of the granules contain a compound represented by the following Formula [A] and the granules impart a pH of not higher than 5.0 to an aqueous solution when dissolved in water.

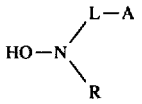

Formula [A]

wherein L represents an alkylene group; A represents a carboxyl group, a sulfo group, a phosphono group, a phosphinic acid residual group, a hydroxy group, an amino group, an ammonio group, a carbamoyl group, a cyano group, or a sulfamoyl group; and R represents a hydrogen atom or an alkyl group.

The above-mentioned objects can be achieved further with the following means; (1) a solid color-developing composition for silver halide color photographic light-sensitive material use, in which the above-mentioned granules and an alkali agent are mixed together; (2) a process of granulating color-developing chemicals for silver halide color photographic light-sensitive material containing at least one of paraphenylenediamine type compounds; the process comprising the steps of adding thereto at least one of the compounds represented by said Formula [A], adjusting composition of the mixture so as to impart the pH of not more than 5.0 to an aqueous solution in which the granules are dissolved and, thereafter, granulating the granule; and (3) a tablet-form color-developing chemicals for silver halide color photographic light-sensitive material, which is prepared by compression-molding the granules thereof.

DETAILED DESCRIPTION OF THE INVENTION

The weight average particle-size of the above-mentioned granules is preferable to be within the range of 150 to 2000 μm. When the granules are color-developing chemicals for silver halide color photographic light-sensitive material use, which contain a sugar and/or a water-soluble polymer, a blocking can be prevented thereby.

On the color-developing chemical granules for silver halide color photographic light-sensitive material, which contains a paraphenylenediamine type compound, the present inventors have discovered the following facts, through the experiments thereof.

If granules for color-development use containing a paraphenylenediamine type compound are moisture-proof packaged under the conditions of a high temperature and a high humidity without containing any compound represented by Formula [A], there raises a problem so serious that a color-tint is produced. When granules containing a paraphenylenediamine compound and granules containing a compound represented by Formula [A] are simply mixed up, any satisfactory color-tint prevention effect cannot be obtained, though a coloration may be improved to some extent. When a drying temperature is so raised as to improve the drying efficiency in the course of preparing the granule, a paraphenylenediamine compound is deteriorated in the course of carrying out a drying treatment so as to be problematic in carrying out a photographic process.

On the other hand, when a granulation is carried out by mixing a paraphenylenediamine compound and a compound represented by Formula [A] together, any color-tint prevention effect cannot also be obtained and a deterioration is also be produced in the course of preparing the granule, if the pH of a granule exceeds 5.0.

When hydroxyl amine sulfate is used, any deterioration prevention effect cannot be obtained in the course of preparing granules, even if the pH thereof is controlled to be not higher than 5.0.

When further studying thereon based on the above-mentioned results, it was discovered to provide granules for color-development use containing a paraphenylenediamine compound, that is a stable color-developing chemical granule for silver halide color photographic light-sensitive material, wherein a color-tint can be prevented under the conditions of a high temperature and a high humidity and any deterioration cannot be produced even if a drying temperature is raised in the course of preparing the granules thereof by mixing; by mixing a compound represented by Formula [A] and further by adjusting the pH of the granule to be not higher than 5.0 when dissolved in water.

When compression-molding the above-mentioned color-developing chemical granules, it was also found to obtain not only the above-mentioned effects, but also such an amazing effect that no granule adheres to a molding pestle in the course of making a continuous tableting.

The granules of the invention contain a paraphenylenediamine compound and a compound represented by Formula [A] in at least a part of the granules. For example, there may be some instances where a part of small granules may contain only a paraphenylenediamine type compound or only a compound represented by Formula [A] in the course of carrying out the processing steps of preparing granules. It is the matter of course that these instances are included in the scope of the invention.

A compound represented by Formula [A] may be contained in a granule. In the case of a wet-type granulation, the compound may be added in the form of a solid, or in the form of a liquid prepared by dissolving the compound in a solvent, when making the granulation. In the case of a dry-type granulation, it is allowed to take any granulation process, such as an addition of the compound in the form of a solid. The above-mentioned methods of adding the compounds may also be taken independently or in combination.

In the case of granules of the invention prepared in the wet-type granulation, it is preferable from the viewpoint of the effects of the invention to granulate the granules after mixing a paraphenylenediamine compound and a compound represented by Formula [A] together. It is further preferable that it is granulated by mixing a paraphenylenediamine compound and a compound represented by Formula [A] together and then by adding a solution prepared by dissolving a compound represented by Formula [A] in a solvent.

The solvents capable of dissolving a compound represented by Formula [A] include, preferably, a polar solvent such as water, alcohol, acetone and acetonitrile. They may be mixed up in combination. From the viewpoints of the safety of worker's body (or the safety of working environment), anti-explosiveness, the simple handling of an instrument, the cost of an instrument and so forth, water is further preferred.

In the invention, the term, "a weight averaged particle-size" means a value obtained in the manner that a sample is passed through a JIS-Standard sieve and the value is calculated out in the following formula by making use of the weight of the sample remaining on the sieve. The meshes of the sieves used therein were 3360, 2830, 1410, 1000, 710, 500, 350, 210, 149, 105 and 37 μm.

$$L_{AVE}=\Sigma(Wi\times Li)/\Sigma Wi$$

wherein Wi represents a weight of a sample remaining on a sieve of number i; Li represents a mesh-size of a sieve number i; and $L_{AVE}$ represents a weight averaged particle-size.

From the viewpoint of the blocking prevention between particles, it is preferable when a weight averaged particle-size $L_{AVE}$ calculated out in the above-mentioned method is within the range of 150 to 2000 μm.

In the invention, the term, a pH exhibited when the granules are dissolved in water, is a pH obtained when the granules are suitably taken separately in an amount that gives the content of a paraphenylenediamine compound of 7.0 g and the granules taken are then dissolved in water to make one liter.

It is preferable that when the above-mentioned granules are dissolved in water, the pH of the solution is to be not higher than 5.0, from such a viewpoint that the deterioration of a paraphenylene-diamine type compound can be prevented in preparing the granule, and that the granule can be prevented from color-tinting under the conditions of a high temperature and a high humidity. When making the pH not higher than 4.0 (particularly not higher than 3.5), the above-mentioned effects can further be displayed. The pH can be optimally adjusted, without deteriorating effects of the invention, by a well-know method.

In the invention, the term, a moisture content, means a percentage by weight (wt %) obtained in such a manner that all the weight of a subject matter reduced when heating the subject at 90° C. for 20 minutes by making use of an electronic moisture meter available on the market, such weight is converted into the moisture.

As for the processes for preparing the above-mentioned granules, the following well-known processes may be used; namely, a rolling granulation process, an extrusion granulation process, a compression granulation process, a cracking granulation process, an agitation granulation process, a fluidized-bed granulation process and a spray-dry granulation process. Among them, a wet type granulation process is preferred from the viewpoint of a granule strength.

Tablet type solid processing chemicals may be prepared by making use of a well-known compressor. The machines applicable thereto include, for example, a hydraulic press, a single-shot type tableting machine, a rotary type tableting machine and a briquetting machine. The tablet form solid processing chemicals may take any desired forms. However, the cylindrical form is preferred from the viewpoints of productivity and easy handling.

With regard to the sizes of the above-mentioned solid processing chemicals, it is preferable that the diameter is 5 to 50 mm and the thickness is 2 to 20 mm. It is particularly preferable that the ratio of a diameter to a thickness is 1 to 4.

Solid processing chemicals of the invention is to contain at least one of paraphenylenediamine compounds and at least one of the compounds represented by Formula [A], provided that two or more each of paraphenylenediamine compounds and/or the compounds represented by Formula [A] may also be contained in combination.

When a granule of the invention for color-development use and a solid alkaline agent are mixed together, there discovered not only an effect of preventing a color-tint, but also, amazingly, another effect that an acidic-alkaline reaction of the alkali agent with a color developing agent can remarkably be prevented.

In the invention, an alkali-agent means a compound capable of imparting an alkalinity of not lower than pH 8.0 when 7.0 g of the alkali agent is dissolved in water to make one liter. The concrete examples thereof include, preferably, an alkali-metal compound such as sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (or borax), potassium tetraborate, potassium hydroxide, sodium hydroxide and lithium hydroxide. From the viewpoint of the effects of the invention, sodium carbonate, sodium bicarbonate, sodium borate and trisodium phosphate are preferred. Among them, sodium carbonate is particularly preferred in the invention.

As a paraphenylenediamine compound, is preferabe a compound having a water-solubilizing group. The paraphenylenediamine compound having a water-solubilizing group include, for example, those having a water-solubilizing group at an amino group or on a benzene nucleus of the paraphenylenediamine compound. The typical water-solubilizing groups include, preferably, $-(CH_2)_nCH_2OH$, $-(CH_2)_mNHSO_2(CH_2)_nCH_3$, $-(CH_2)_mO(CH_2)_nCH_3$, $-(CH_2CH_2O)_nC_mH_{2m+1}$, —COOH group, and $-SO_3H$ group (in which m and n are each an integer of not less than 0).

The typical exemplified compounds of paraphenylenediamine compounds preferably applicable to the invention include, for example, (C-1) through (C-16) given in JP OPI Publication No. 4-86741/1992, pp. 7–9, and (1) through (26) given in ibid., No. 4-246543/1991, pp. 6–10. The above-mentioned color developing agents are commonly used in the forms of a hydrochloride, a sulfate, a p-toluenesulfonate or the like. The compounds preferably applicable to the invention will be given below; however, the paraphenylenediamine compounds of the invention shall not be limited thereto.

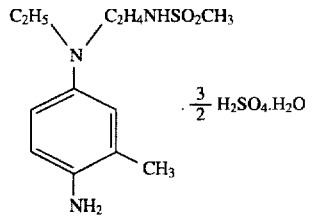

(C-1)

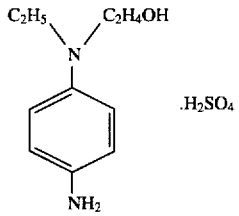

(C-2)

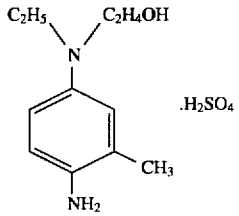

(C-3)

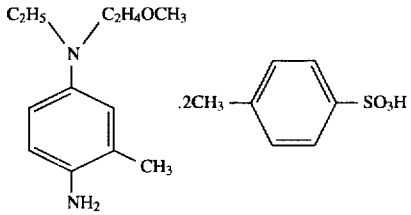

(C-4)

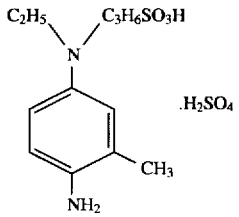

(C-5)

-continued
(C-6)
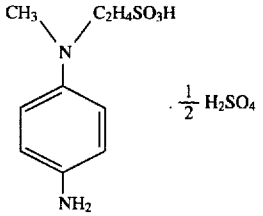
(C-7)
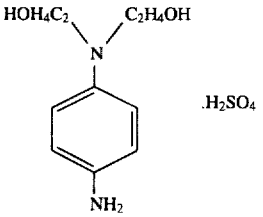
(C-8)
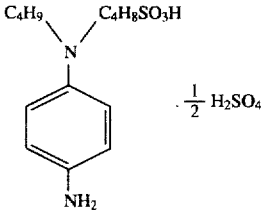
(C-9)
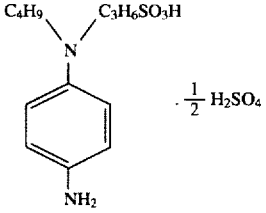
(C-10)
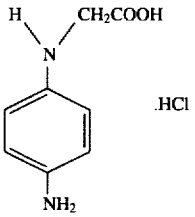
(C-11)
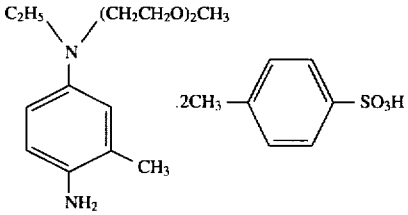
(C-12)
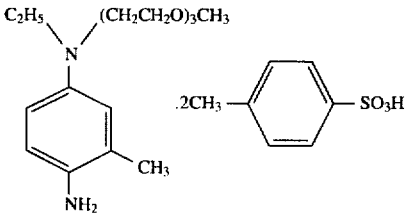
-continued
(C-13)
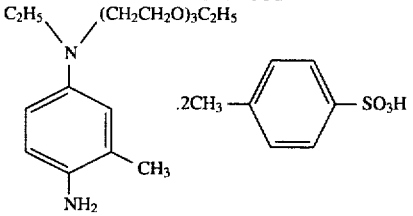
(C-14)
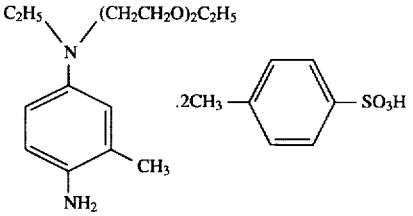
(C-15)
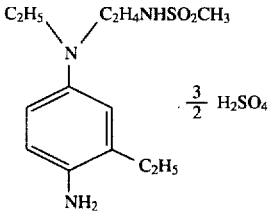
(C-16)
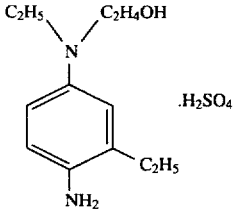
(C-17)
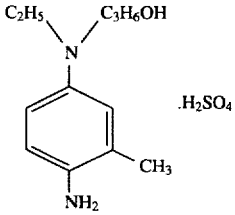
(C-18)
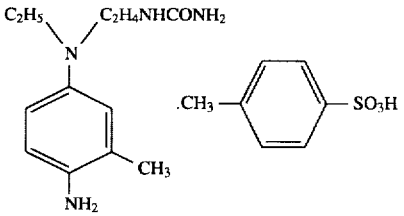
(C-19)
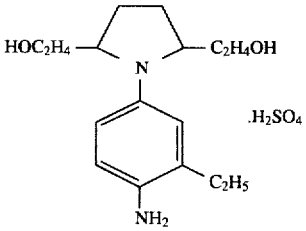

-continued (C-20)

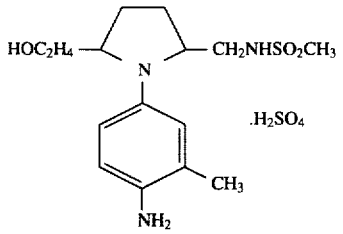

Among the above-given compounds, those preferably applicable thereto include, for example, (C-1), (C-3) and (C17) through (C-20) and, particularly, (C-1) and (C-3).

Now, the compounds represented by Formula [A] will be detailed below.

L represents an alkylene group and, preferably, a straight-chained or branched alkylene group having 1 to 10 carbon atoms, which may be substituted by a substituent. Among them, those having 1 to 5 carbon atoms are particularly preferred. To be more concrete, methylene, ethylene, trimethylene or propylene may be given as the particularly preferable examples thereof. The above-mentioned substituent includes, for example, a carboxy group, a sulfo group, a phosphono group, a phosphinic acid residual group, a hydroxy group or an ammonio group which may be substituted by an alkyl group and, preferably, a carboxy group, a sulfo group, a phosphono group or a hydroxy group. A represents, for example, a carboxy group, a sulfo group, a phosphono group, a phosphinic acid residual group, a hydroxy group, a cyano group, an alkoxy group, an amino group, which may be substituted by an alkyl group, an alkyl-(preferably having 1 to 5 carbon atoms)-substitutable ammonio group, an alkyl-(preferably having 1 to 5 carbon atoms)-substitutable carbamoyl group or an alkyl-(preferably having 1 to 5 carbon atoms)-substitutable sulfamoyl group and, preferably among them, a carboxy group, a sulfo group, a hydroxy group, a phosphono group, a cyano group, an alkoxy group or an alkyl-substitutable carbamoyl group. The examples of -L-A include, preferably, a carboxymethyl group, a carboxyethyl group, a carboxypropyl group, a sulfoethyl group, a sulfopropyl group, a sulfobutyl group, a phosphonomethyl group, a phosphonoethyl group, a methoxyethyl group, a cyanoethyl group or a hydroxyethyl group and, particularly among them, a carboxymethyl group, a carboxyethyl group, a sulfoethyl group, a sulfopropyl group, a phosphonomethyl group, a methoxyethyl group, a cyanoethyl group or a phosphonoethyl group. R represents an alkyl group including, preferably, an alkyl group having a substitutable straight-chain or a branched chain having 1 to 10 carbon atoms and, preferably among them, those having 1 to 5 carbon atoms. The substituents include, for example, a carboxy group, a sulfo group, a phosphono group, a sulfinic acid residual group, a hydroxy group, a cyano group, an alkoxy group, an alkyl-substitutable amino group, an alkyl-substitutable ammonio group, an alkyl-substitutable carbamoyl group, an alkyl-substitutable sulfamoyl group, a substitutable alkylsulfonyl group, an acylamino group, an alkylsulfonylamino group, an arylsulfonylamino group, an alkoxycarbonyl group, an arylsulfonyl group, a nitro group, a cyano group or a halogen atom. Two or more substituents may also be made present. R represents, preferably, a hydrogen atom, a methyl group, an ethyl group, a propyl group, a carboxymethyl group, a carboxyethyl group, a carboxypropyl group, a sulfoethyl group, a sulfopropyl group, a sulfobutyl group, a phosphonomethyl group, a phosphonoethyl group, a methoxyethyl group, a cyanoethyl group or a hydroxyethyl group and, particularly among them, a hydrogen atom, a carboxymethyl group, a carboxyethyl group, a sulfoethyl group, a sulfopropyl group, a phosphonomethyl group, a methoxyethyl group, a cyanoethyl group or a phosphonoethyl group. It is also allowed that L and R may be linked to each other so as to form a ring.

The compounds represented by Formula [A] may be used in the form of a free amine, a hydrochloride, a sulfate, a p-toluenesulfonate, an oxalate, a phosphate or an acetate.

In view of the objects of the invention, the compounds represented by Formula [A] are preferable to be in the solid form Among the compounds represented by Formula [A], the typical examples thereof will be given below; however, the invention shall not be limited thereto.

(1)

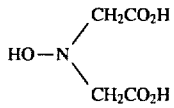

(2)

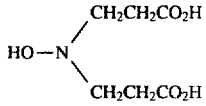

(3)

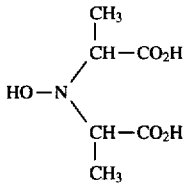

(4)

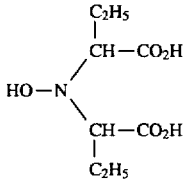

(5)

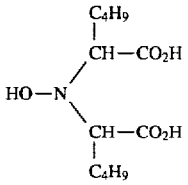

(6)

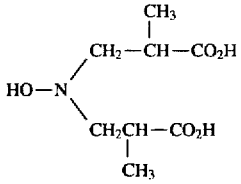

(7)

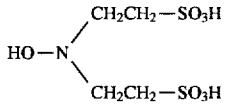

(8)

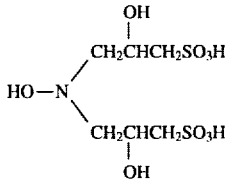

-continued
(9)
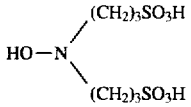
(10)
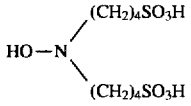
(11)
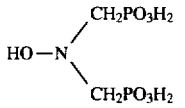
(12)
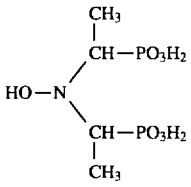
(13)
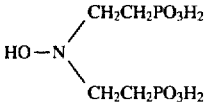
(14)
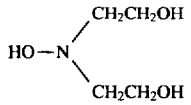
(15)
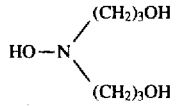
(16)
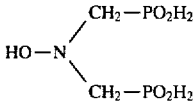
(17)
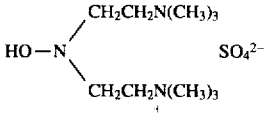
(18)
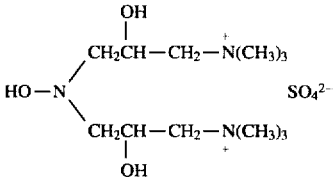
(19) $HO-NH-CH_2CO_2H$
(20) $HO-NH-CH_2CH_2CO_2H$
(21)
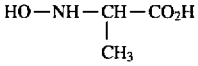
(22)
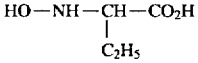
(23)
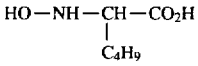
-continued
(24)
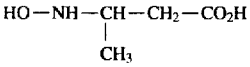
(25)
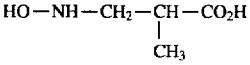
(26) $HO-NH-CH_2CH_2SO_3H$
(27)
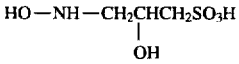
(28) $HO-NH-(CH_2)_3SO_3H$
(29) $HO-NH-(CH_2)_4SO_3H$
(30) $HO-NH-CH_2PO_3H_2$
(31)
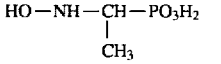
(32) $HO-NH-CH_2CH_2PO_3H_2$
(33) $HO-NH-CH_2CH_2OH$
(34) $HO-NH-(CH_3)_3OH$
(35) $HO-NH-CH_2-PO_3H_2$
(36)
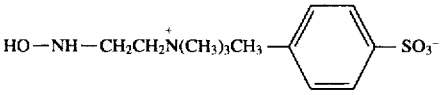
(37)
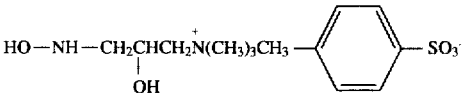
(38)
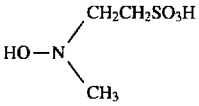
(39)
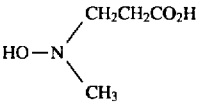
(40)
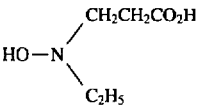
(41)
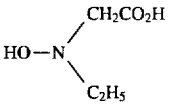
(42)
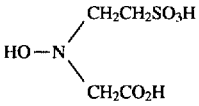
(43)
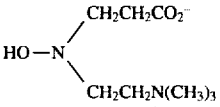
(44)
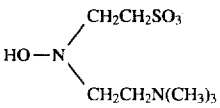

-continued (45)

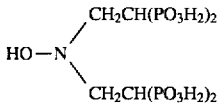

(46)

$HONHCH_2CH(PO_3H_2)_2$ (47)

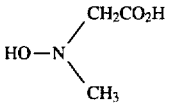

(48)

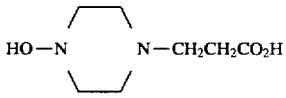

(49)

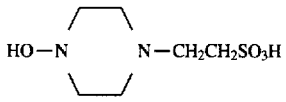

(50)

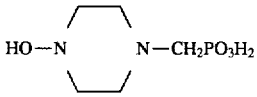

(51)

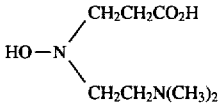

(52)

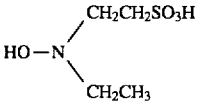

(53)

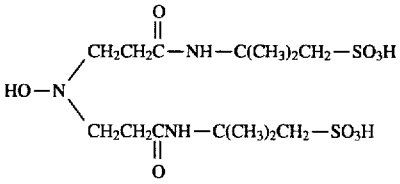

(54)

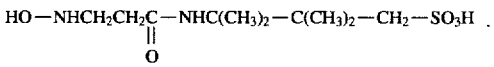

(55)

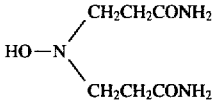

(56)

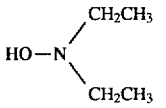

(57)

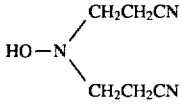

(58)

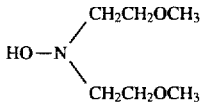

Among the above-given examples, the preferably compounds include, for example, (2), (7), (14), (38), (39), (40), (55) and (58). These compounds may also be added in the form of an alkali-metal salt or an ammonium salt.

Among them, the particularly preferable compounds include, for example, the following compounds.

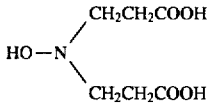

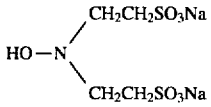

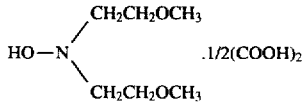

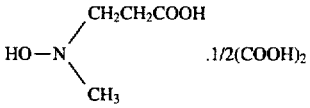

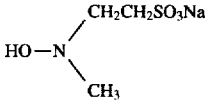

The compounds represented by Formula [A] may be synthesized by making an alkylation reaction (such as a nucleophilic substitution reaction, an adduct reaction and a Mannich reaction) of a hydroxyl amine available on the market. The synthesization thereof may be performed with reference to such a synthesization process as described in, for example, West German Patent Publication No. 1,159,634, "Inorganica Chimica Acta", 93, (1984), pp. 101–108, and so forth.

When adding a compound represented by Formula [A], the molar ratio thereof to a paraphenylenediamine compound is to be within the range of, preferably, 0.01 to 3.0 and, particularly, 0.05 to 2.0.

When the above-mentioned mol ratio exceeds 3.0, a drying time has to be so prolonged as to produce a color-tint resultingly.

From the viewpoint of improving a blocking behavior (a flocculation of each other solid processing chemicals) produced when absorbing a moisture, it is preferable to contain a sugar and/or a water-soluble polymer in a granule of the invention for color-development use.

In the invention, the term, a saccharide, means a monosaccharide or a polysaccharide formed of plural monosaccharides glycoside-bonded to each other.

The term, a monosaccharide, herein means the generic name covering a single polyhydroxyaldehyde or polyhydroxy-ketone and a wide range of the derivatives thereof such as a reduced derivative, oxidized derivative, a deoxy derivative, an amino derivative and a thio derivative. Most saccharides may be represented by the formula, $C_nH_{2n}O_n$. In the invention, not only the saccharide represented by $C_nH_{2n}O_n$ but also the compounds induced from the saccharide skeletons represented by the above-mentioned formula are defined as monosaccharides. Among these monosaccharides, the preferable include, for example, a sugar alcohol having the primary and secondary alcohol groups formed respectively by reducing the aldehyde and ketone groups each of sugar. The particularly preferable include, for example, hexitol having 6 carbon atoms.

Polysaccharides include, for example, a cellulose, a starch and a glycogen. The celluloses include, for example, the derivatives thereof such as cellulose ether in which all or a part of the hydroxyl groups are etherified. The starches include, for example, a dextrin that is a variety of degradation product ranged up to a malt sugar processed in a hydrolysis. From the viewpoint of a solubility, a cellulose may also be in the form of an alkali-metal salt. Among these polysaccharides, those preferably applicable include, for example, a cellulose and a dextrin and, more preferably, a dextrin.

The concrete exemplified monosaccharide compounds of the invention will be given below.

| (Exemplified compounds) | |
|---|---|
| B-(1) | Glyceraldehyde |
| B-(2) | Dihydroxyacetone (including the dimers) |
| B-(3) | D-erythrose |
| B-(4) | L-erythrose |
| B-(5) | D-threose |
| B-(6) | L-threose |
| B-(7) | D-ribose |
| B-(8) | L-ribose |
| B-(9) | D-arabinose |
| B-(10) | L-arabinose |
| B-(11) | D-xylose |
| B-(12) | L-xylose |
| B-(13) | D-lyxose |
| B-(14) | L-lyxose |
| B-(15) | D-xylulose |
| B-(16) | L-xylulose |
| B-(17) | D-ribulose |
| B-(18) | L-ribulose |
| B-(19) | 2-deoxy-D-ribose |
| B-(20) | D-allose |
| B-(21) | L-allose |
| B-(22) | D-altrose |
| B-(23) | L-altrose |
| B-(24) | D-glucose |
| B-(25) | L-glucose |
| B-(26) | D-mannose |
| B-(27) | L-mannose |
| B-(28) | D-gulose |
| B-(29) | L-gulose |
| B-(30) | D-idose |
| B-(31) | L-idose |
| B-(32) | D-galactose |
| B-(33) | L-galactose |
| B-(34) | D-talose |
| B-(35) | L-talose |
| B-(36) | D-quinovose |
| B-(37) | Digitalose |
| B-(38) | Digitoxose |
| B-(39) | Cymarose |
| B-(40) | D-sorbose |
| B-(41) | L-sorbose |
| B-(42) | D-tagatose |
| B-(43) | D-fucose |
| B-(44) | L-fucose |
| B-(45) | 2-deoxy-D-glucose |
| B-(46) | D-psicose |
| B-(47) | D-fructose |
| B-(48) | L-fructose |
| B-(49) | L-rhamnose |
| B-(50) | D-glucosamine |
| B-(51) | D-galactosamine |
| B-(52) | D-mannosamine |
| B-(53) | D-glycero-D-galactoheptose |
| B-(54) | D-glycero-D-mannoheptose |
| B-(55) | D-glycero-L-mannoheptose |
| B-(56) | D-glycero-D-gloheptose |
| B-(57) | D-glycero-D-idoheptose |
| B-(58) | D-glycero-L-glucoheptose |
| B-(59) | D-glycero-L-taloheptose |
| B-(60) | D-altroheptulose |
| B-(61) | D-mannoheptulose |
| B-(62) | D-altro-3-heptulose |
| B-(63) | D-glucuronic acid |
| B-(64) | L-glucuronic acid |
| B-(65) | N-acetyl-D-glucosamine |
| B-(66) | Glycerol |

-continued

| (Exemplified compounds) | |
|---|---|
| B-(67) | D-threitol |
| B-(68) | L-threitol |
| B-(69) | meso-erythritol |
| B-(70) | D-arabitol |
| B-(71) | L-arabitol |
| B-(72) | Adonitol |
| B-(73) | tylitol |
| B-(74) | D-sorbitol |
| B-(75) | L-sorbitol |
| B-(76) | D-mannitol |
| B-(77) | L-mannitol |
| B-(78) | D-iditol |
| B-(79) | L-iditol |
| B-(80) | D-talitol |
| B-(81) | L-talitol |
| B-(82) | Dulcitol |
| B-(83) | Allodulcitol |

Among the above-given exemplified compounds, those preferably applicable include, for example, B-(66) through (83) and those more preferably applicable include, for example, B-(69) and B-(74) through (83).

The concrete exemplified compounds of the polysaccharides of the invention will be given below.

| | |
|---|---|
| D-(1) | Malt sugar (maltose) |
| D-(2) | Cellobiose |
| D-(3) | Trehalose |
| D-(4) | Gentiobiose |
| D-(5) | Isomaltose |
| D-(6) | Milk sugar |
| D-(7) | Raffinose |
| D-(8) | Gentianose |
| D-(9) | Stachyose |
| D-(10) | Xylan |
| D-(11) | Araban |
| D-(12) | Glycogen |
| D-(13) | Dextran |
| D-(14) | Inulin |
| D-(15) | Levan |
| D-(16) | Galactan |
| D-(17) | Agarose |
| D-(18) | Amylose |
| D-(19) | Sucrose |
| D-(20) | Agarobiose |
| D-(21) | Methyl cellulose |
| D-(22) | Dimethyl cellulose |
| D-(23) | Trimethyl cellulose |
| D-(24) | Ethyl cellulose |
| D-(25) | Diethyl cellulose |
| D-(26) | Triethyl cellulose |
| D-(27) | Carboxymethyl cellulose |
| D-(28) | Carboxyethyl cellulose |
| D-(29) | Aminoethyl cellulose |
| D-(30) | Hydroxymethyl cellulose |
| D-(31) | Hydroxyethyl cellulose |
| D-(32) | Hydroxypropyl cellulose |
| D-(33) | Hydroxypropylmethyl cellulose |
| D-(34) | Hydroxypropylmethyl celluloseacetate succinate |
| D-(35) | Carboxymethylhydroxyethyl cellulose |
| D-(36) | α-dextrin |
| D-(37) | β-dextrin |
| D-(38) | γ-dextrin |
| D-(39) | δ-dextrin |
| D-(40) | ε-dextrin |
| D-(41) | α-limiting dextrin |
| D-(42) | β-limiting dextrin |
| D-(43) | phosphorylase limiting dextrin |
| D-(44) | Soluble starch |
| D-(45) | Dilute paste starch |
| D-(46) | White dextrin |
| D-(47) | Yellow dextrin |
| D-(48) | British gum |
| D-(49) | α-cyclodextrin |
| D-(50) | β-cyclodextrin |

-continued

| | |
|---|---|
| D-(51) | γ-cyclodextrin |
| D-(52) | Hydroxypropyl-α-cyclodextrin |
| D-(53) | Hydroxypropyl-β-cyclodextrin |
| D-(54) | Hydroxypropyl-γ-cyclodextrin |
| D-(55) | Malt dextrin |

Among the above polysaccharides, those preferably applicable include, for example, D-(21) through D-(55) and, particularly, D-(36) through D-(55). The weight averaged molecular weight of dextrins applicable to the invention may not be limited, but preferably within the range of 10 to 10000.

Degradation products of starch available on the market include, for example, a series of Pine-Flow and Pine-Dex produced by Matsutani Chemical Industrial Co., Ltd., Foodtex, Max 100, Glister-P, TK-16, MPD, H-PDX Stuccodex, and a series of Oil Q produced by Nihon Yushi Co.

A sugar occurs widely in nature and is readily available on the market. A variety of derivatives thereof can also easily be synthesized by making a reduction, oxidation or dehydration reaction.

Next, the water-soluble polymers of the invention will be detailed. The preferable examples thereof will be given below.

The water-soluble polymers include, for example, polyalkylene glycol, polyvinyl pyrrolidone (or PVP), polyvinyl alcohol (or PVA), polyvinyl acetate, an aminoalkyl methacrylate copolymer, a methacrylic acid-methacrylate copolymer, a methacrylic acid-acrylate copolymer and a methacrylic acid betaine type polymer. As the polyalkylene glycols is preferable a compound represented by the following Formula [9 ].

Formula [9 ]

$$HO—(AO)_s—(BO)_t—(DO)_u—H$$

wherein A, B and D represent each a branched or straight-chained alkylene group having 1 to 5 carbon atoms, provided that A, B and D may be the same as or different from each other; and s, t and u are each an integer of 0 to 500. Among these compounds, polyethylene glycol (or PEG), polypropylene glycol or poly-trimethylene glycol each having an average molecular weight within the range of 400 to 20000 are preferably be used in the invention. Besides, those prepared by copolymerization, in a specific ratio, ethylene glycol and propylene glycol each having an average molecular weight within the range of 2000 to 10000 are also preferably used in the invention. To be more concrete, polyethylene glycol having an average molecular weight within the range of 1500 to 10000 is particularly preferred. These polyethylene glycols are readily available on the market. For example, polyethylene glycols having an average molecular weight within the range of 1300 to 1600 (that is PEG #1540), 1800 to 2200 (that is PEG #2000), 3000 to 4000 (that is PEG #4000), 6000 to 7500 (that is PEG #6000) and 9000 to 12500 (that is PEG #10000) are each available on the market and they are more preferably used in the invention.

In the invention, an average molecular weight is calculated out based on a hydroxyl value.

In the invention, a total adding amount of a sugar and a water-soluble polymer is preferably, not less than 0.5 wt % of a granule for color-development use and more preferably not more than 15 wt % (or not more than 10 wt % in particular) thereof.

Examples

Example 1

| Procedure (1-1) | |
|---|---|
| Exemplified compound [C] (See Table 1) | 44 mols |
| Exemplified compound [A] (See Table 1) | 14 mols |

Each of the above-given compounds was pulverized so as to have a particle-size of not larger than 100 μm by making use of a hammer-mill available on the market. An alkali agent shown in Table 1 was pulverized in the same manner as above and it was added to each of the pulverized compounds so that the resulting granules imparted the pH shown in Table 1. Thereafter, the resulting mixture was mixed up well in a stirring granulator commecially available, and water was then added thereto so as to be granulated thereby. While dropping water in an amount of 6 wt % of the total weight of the raw materials used in the granulation at a rate of 750 ml/min., the granulation was carried out for about 4 minutes. The resulting granules were dried up while the hot air blow is so controlled as not to exceed 50° C. and 65° C. by making use of a fluid-bed dryer available on the market. During and after the drying treatment, the granules were subjected to dressing in size through a 1.5 mm-mesh screen by making use of a grain-dressing machine available on the market. The drying treatment was carried out until the moisture content of the granules became not more than 1.5 wt %. The resulting granules are denoted by samples (1-1) through (1-22), respectively.

Experiment (1-1)

One hundred (100) grams each of the granules prepared by controlling the temperature so as not to exceed 50° C. were preserved respectively in an opened schale (or an opened laboratory dish) and were then aged for 10 hours in an incubator at 50° C. and 80% RH.

After completion of aging, the appearance of each sample was evaluated based on the following criteria. The results thereof will be shown in Table 1.

Criteria for the evaluation:

◎◎: Not color-tinted at all,

◎: Partly color-tinted with a few small spots,

○: Partly color-tinted, but it is less than 10% of the whole,

Δ: Partly color-tinted, but it is not more than 30% of the whole,

X: Color-tinted on more than half of the whole, and

XX: Color-tinted on the whole.

Experiment (1-2)

In 100 g each of the granules prepared by controlling the temperature so as not to exceed 65° C., paraphenylenediamine compounds given in Exemplified Compounds [C] were quantitatively determined before and after making the drying treatment, so that the residual ratio (in %) thereof in the preparation of the granules was calculated out.

Residual ratio (%)=[a quantity after drying (g/liter) / a quantity before drying (g/liter)]×100

The results thereof will be shown in Table 1.

TABLE 1

| Sample No. | Compound [C] | Compound [A] | Alkali-metal salt | pH of granule | Color-tint | Residual ratio in preparation (%) | Remarks |
|---|---|---|---|---|---|---|---|
| 1-1 | C-1 | Not added | Potassium carbonate | 3.0 | X | 70.3 | Comp. |
| 1-2 | C-1 | Hydroxyl amine sulfate | Potassium carbonate | 3.0 | Δ | 78.5 | Comp. |
| 1-3 | C-1 | (2) | Potassium carbonate | 5.5 | X | 65.4 | Comp. |
| 1-4 | C-1 | " | Potassium hydroxide | 5.5 | X | 64.2 | Comp. |
| 1-5 | C-3 | Not added | Potassium carbonate | 3.0 | X | 69.5 | Comp. |
| 1-6 | C-3 | Hydroxyl amine sulfate | Potassium carbonate | 3.0 | Δ | 76.7 | Comp. |
| 1-7 | C-3 | (2) | Potassium carbonate | 5.5 | X | 66.3 | Comp. |
| 1-8 | C-3 | " | Potassium hydroxide | 5.5 | X | 65.1 | Comp. |
| 1-9 | C-1 | Disodium salt of (7) | Potassium carbonate | 2.8 | ⊙ | 99.6 | Inv. |
| 1-10 | C-1 | Disodium salt of (7) | Potassium carbonate | 3.0 | ⊙ | 99.3 | Inv. |
| 1-11 | C-1 | Disodium salt of (7) | Potassium carbonate | 3.5 | ⊙ | 98.9 | Inv. |
| 1-12 | C-1 | Disodium salt of (7) | Potassium carbonate | 4.0 | ○ | 98.7 | Inv. |
| 1-13 | C-1 | Disodium salt of (7) | Potassium carbonate | 4.5 | ○ | 92.0 | Inv. |
| 1-14 | C-1 | Disodium salt of (7) | Potassium carbonate | 5.0 | ○ | 92.3 | Inv. |
| 1-15 | C-1 | Disodium salt of (7) | Potassium carbonate | 5.5 | X | 68.7 | Comp. |
| 1-16 | C-3 | Disodium salt of (7) | Potassium carbonate | 2.8 | ⊙ | 99.2 | Inv. |
| 1-17 | C-3 | Disodium salt of (7) | Potassium carbonate | 3.0 | ⊙ | 99.1 | Inv. |
| 1-18 | C-3 | Disodium salt of (7) | Potassium carbonate | 3.5 | ⊙ | 99.6 | Inv. |
| 1-19 | C-3 | Disodium salt of (7) | Potassium carbonate | 4.0 | ○ | 98.3 | Inv. |
| 1-20 | C-3 | Disodium salt of (7) | Potassium carbonate | 4.5 | ○ | 92.9 | Inv. |
| 1-21 | C-3 | Disodium salt of (7) | Potassium carbonate | 5.0 | ○ | 93.4 | Inv. |
| 1-22 | C-3 | Disodium salt of (7) | Potassium carbonate | 5.5 | X | 67.7 | Comp. |

Comp.: Comparison
Inv.: Invention

As is obvious from Table 1, it is possible to provide a color-developing agent granule for silver halide color photographic light-sensitive material use containing a paraphenylenediamine compound, wherein a compound represented by Formula [A] is contained and the pH of the granule is controlled to be not higher than 5.0, thereby a color-tint can be prevented in preservation and any deterioration can also be inhibited in preparation. And, when the pH of the granule is kept to be not higher than 4.0, the deterioration can further be inhibited in preparation and, when keeping the pH thereof not higher than 3.5, the prevention effects of the deterioration in preparation and the color-tint in aging can remarkably be improved.

Example 2

| Procedure (2-1) | |
|---|---|
| Exemplified compound [C] (See Table 2) | 30 mols |
| Exemplified compound [A] (See Table 2) | 30 mols |

Each of the above-given compounds was pulverized in the same manner as in Example 1. The resulting pulverized compounds were mixed up well respectively in a stirring granulator and thereto was then added water, so as to be granulated. While dropping water in an amount of 6 wt % of the total weight of the raw materials used in the granulation at a rate of 750 ml/min., granulation was carried out however, the pH of the granules, when dissolved in water, were within the scope of the invention.

The resulting granules were dried up until the moisture content thereof could be not more than 1.5 wt % and were subjected to dressing in particle size under the same conditions as in Example 1. The resulting granules are denoted as Samples (2-1) through (2-24).

Experiment (2 - 1 )

Under the same criteria as in Example 1, the color-tint produced in preservation and the residual ratio in preparation were each evaluated.

The results thereof will be shown in Table 2.

TABLE 2

| Sample No. | Compound [C] | Compound [A] | Color-tint | Residual ratio in preparation (%) | Remarks |
|---|---|---|---|---|---|
| 2-1 | C-1 | (2) | ◎ | 99.6 | Invention |
| 2-2 | C-1 | Disodium salt of (7) | ◎ | 99.7 | Invention |
| 2-3 | C-1 | (14) | ○ | 96.8 | Invention |
| 2-4 | C-1 | Sodium salt of (38) | ○ | 97.1 | Invention |
| 2-5 | C-1 | 1/2 oxalate of (39) | ○ | 95.8 | Invention |
| 2-6 | C-1 | 1/2 oxalate of (40) | ○ | 96.2 | Invention |
| 2-7 | C-1 | (55) | ○ | 96.5 | Invention |
| 2-8 | C-1 | 1/2 oxalate of (56) | ○ | 90.1 | Invention |
| 2-9 | C-3 | (2) | ◎ | 99.8 | Invention |
| 2-10 | C-3 | Disodium salt of (7) | ◎ | 99.5 | Invention |
| 2-11 | C-3 | (14) | ○ | 96.6 | Invention |
| 2-12 | C-3 | Sodium salt of (38) | ○ | 97.4 | Invention |
| 2-13 | C-3 | 1/2 oxalate of (39) | ○ | 96.3 | Invention |
| 2-14 | C-3 | 1/2 oxalate of (40) | ○ | 95.9 | Invention |
| 2-15 | C-3 | (55) | ○ | 96.1 | Invention |
| 2-16 | C-3 | 1/2 oxalate of (56) | ○ | 89.7 | Invention |
| 2-17 | C-17 | (2) | ◎ | 96.3 | Invention |
| 2-18 | C-17 | Disodium salt of (7) | ◎ | 97.1 | Invention |
| 2-19 | C-19 | (2) | ◎ | 96.7 | Invention |
| 2-20 | C-19 | Disodium salt of (7) | ◎ | 96.9 | Invention |
| 2-21 | C-20 | (2) | ◎ | 97.2 | Invention |
| 2-22 | C-20 | Disodium salt of (7) | ◎ | 97.3 | Invention |
| 2-23 | C-1 | Hydroxyl amine sulfate | Δ | 78.6 | Comparison |
| 2-24 | C-3 | Hydroxyl amine sulfate | Δ | 79.1 | Comparison |

As is obvious from Table 2, the effects of the invention were further displayed when the paraphenylenediamine compound is C-1 or C-3.

It was proved that, among the compounds represented by Formula [A], those containing a carboxyl group, a sulfo group or a carbamoyl group (or the salts thereof) is preferred from the viewpoint of the effects of the invention, and that bis(carboethyl)hydroxyl amine indicated by (2) and disodium bis(sulfoethyl)hydroxyl amine indicated by (7) are further preferred.

Example 3

| Procedure (3-1) | |
|---|---|
| Exemplified compound [C] (See Table 3) | 13,500 g |
| Disodium salt of Exemplified Compound (7) | In mol ratio shown in Table 3 |

The above-mentioned compounds were pulverized in the same manner as in Example 1. After well mixing the resulting pulverized compounds in a stirring granulator, the granulation was carried out by dropping 1200 ml of water. The resulting granules were dried up and then subjected to dressing of particle in size in the same manner as in Example 1 so that the moisture content thereof was not more than 1.5 wt %. The resulting samples are denoted by (3-1) through (3-16), respectively.

Procedure (3-2)

Samples (3-17) through (3-22) were each prepared in the same manner as in Procedures (3-1), except that disodium salts of Exemplified Compounds (7) were dissolved in dropping water when making the granulation. The results thereof will be shown in Table 3.

TABLE 3

| Sample No. | Compound [C] | Molar ratio of disodium salts of Exemplified Compound (7) to Exemplified Compound [C] | Color-tint | Residual ratio in granule preparation |
|---|---|---|---|---|
| 3-1 | C-1 | 0.005 | ○ | 94.8 |
| 3-2 | C-1 | 0.01 | ○ | 95.0 |
| 3-3 | C-1 | 0.05 | ◎ | 99.1 |
| 3-4 | C-1 | 0.1 | ◎ | 99.3 |
| 3-5 | C-1 | 1 | ◎ | 99.4 |
| 3-6 | C-1 | 2 | ◎ | 99.7 |
| 3-7 | C-1 | 3 | ◎ | 98.0 |
| 3-8 | C-1 | 3.5 | ○ | 96.8 |
| 3-9 | C-3 | 0.005 | ○ | 95.3 |
| 3-10 | C-3 | 0.01 | ○ | 95.0 |
| 3-11 | C-3 | 0.05 | ◎ | 99.5 |
| 3-12 | C-3 | 0.1 | ◎ | 99.5 |
| 3-13 | C-3 | 1 | ◎ | 99.3 |
| 3-14 | C-3 | 2 | ◎ | 99.7 |
| 3-15 | C-3 | 3 | ◎ | 97.9 |
| 3-16 | C-3 | 3.5 | ○ | 96.3 |
| 3-17 | C-1 | 0.005 | ○ | 95.3 |
| 3-18 | C-1 | 0.01 | ○ | 95.2 |
| 3-19 | C-1 | 0.05 | ◎ | 97.1 |
| 3-20 | C-3 | 0.005 | ○ | 95.4 |
| 3-21 | C-3 | 0.01 | ○ | 94.2 |
| 3-22 | C-3 | 0.05 | ◎ | 96.9 |

As is obvious from Table 3, the molar ratio of the compounds represented by Formula [A] to the paraphenylenediamine compounds are advisably within the range of 0.01 to 3.0 and, when it is within the range of 0.05 to 2.0, the effects of the invention were particularly be displayed.

When adding a compound represented by Formula [A], it is proved that the effects of the invention can more be displayed by adding it in the solid form rather than in the liquid form even if the same molar ratio is used when the granulation is carried out.

Example 4

| Procedure (4-1) | |
|---|---|
| Exemplified Compound [C] (See Table 4) | 13,500 g |
| Disodium salt of Exemplified Compound (7) | 2,500 g |

The above-mentioned compounds were each pulverized in the same manner as in Example 1. After the resulting pulverized compounds were mixed up well in a stirring granulator, the granulation was carried out for about 4 minutes by dropping 1000 ml of water at an adding rate of 750 ml/min. The resulting granules were dried up until the moisture content thereof could be 1.5 wt %. while controlling the temperature to be not higher than 60° C. by making use of a fluidized-bed dryer. The resulting granules were subjected to during and after they were dried. At that time, the mesh of a screen was suitably adjusted, thereby controlled the weight average particle-size of the granules. (As for the results, refer to Table 4.) The resulting samples were denoted by (4-1) through (4-16), respectively.

Procedure (4-2)

Samples (4-17) through (4-24) were each prepared in the same manner as in Procedures (4-1), except that water used for making granulation was replaced by an aqueous 10 wt % disodium salts of Exemplified Compounds (7).

Experiment (4-1)

The evaluation on the color-tint produced in aging was tried in the same manner as in Example 1.

The results thereof will be shown in Table 4.

Experiment (4-2)

From the resulting Samples, 100 g each thereof were taken out 20 times, and the content of disodium salts of compound (7) were each quantitatively determined. From the determination results, the fluctuation thereof among the granules of the samples were each evaluated.

The results thereof will be shown in Table 4.

Each evaluation was made based on the following criteria.

◎◎: Every 20-times quantitative determination was within ±3% of the objective quantity, ◎: Every 20-times quantitative determination was within ±4% of the objective quantity, ○: Every 20-times quantitative determination was within ±5% of the objective quantity, and X: Some were not within the range of ±5%.

TABLE 4

| Sample No. | Exemplified compound [C] | Weight average particle-size (in μm) | Color-tint | Fluctuation among granules | Remarks |
|---|---|---|---|---|---|
| 4-1 | C-1 | 120 | ○ | ◎◎ | Invention |
| 4-2 | C-1 | 150 | ◎ | ◎◎ | Invention |
| 4-3 | C-1 | 290 | ◎ | ◎◎ | Invention |
| 4-4 | C-1 | 600 | ◎ | ◎◎ | Invention |
| 4-5 | C-1 | 980 | ◎ | ◎◎ | Invention |
| 4-6 | C-1 | 1,480 | ◎ | ◎◎ | Invention |
| 4-7 | C-1 | 1,520 | ◎ | ◎ | Invention |
| 4-8 | C-1 | 1,990 | ◎ | ◎ | Invention |
| 4-9 | C-1 | 2,210 | ◎ | ○ | Invention |
| 4-10 | C-3 | 110 | ○ | ◎◎ | Invention |
| 4-11 | C-3 | 150 | ◎ | ◎◎ | Invention |
| 4-12 | C-3 | 310 | ◎ | ◎◎ | Invention |
| 4-13 | C-3 | 620 | ◎ | ◎◎ | Invention |
| 4-14 | C-3 | 1,010 | ◎ | ◎◎ | Invention |
| 4-15 | C-3 | 1,490 | ◎ | ◎◎ | Invention |
| 4-16 | C-3 | 1,520 | ◎ | ◎ | Invention |
| 4-17 | C-3 | 1,980 | ◎ | ◎ | Invention |
| 4-18 | C-3 | 2,240 | ◎ | ○ | Invention |
| 4-19 | C-1 | 320 | ◎◎ | ◎◎ | Invention |
| 4-20 | C-1 | 610 | ◎◎ | ◎◎ | Invention |
| 4-21 | C-1 | 1,000 | ◎◎ | ◎◎ | Invention |
| 4-22 | C-1 | 1,480 | ◎◎ | ◎◎ | Invention |
| 4-23 | C-1 | 1,510 | ◎◎ | ◎ | Invention |
| 4-24 | C-3 | 300 | ◎◎ | ◎◎ | Invention |
| 4-25 | C-3 | 590 | ◎◎ | ◎◎ | Invention |
| 4-26 | C-3 | 1,080 | ◎◎ | ◎◎ | Invention |
| 4-27 | C-3 | 1,480 | ◎◎ | ◎◎ | Invention |
| 4-28 | C-3 | 1,510 | ◎◎ | ◎ | Invention |

As is obvious from Table 4, color developing agent granules of the invention, which are capable of reducing color-tint production and fluctuation in size of the granules, can be achieved when controlling the weight averaged particle-size thereof to be within the range of 150 to 2000 μm.

When controlling the weight averaged particle-size thereof to be within the range of 150 to 1500 μm, the above-mentioned effects can further be displayed.

Further, when making use of an aqueous solution of a compound represented by Formula [A] in granulation, an improvement in the color-tint can further be achieved.

Example 5

| Procedure (5-1) | |
|---|---|
| Exemplified Compound [C] (See Table 5) | 13,000 g |
| Disodium salt of Compound (7) | 2,000 g |
| A saccharide or a water-soluble polymer (See Table 5) | Amount shown in Table 5 (in wt % to the whole weight) |

The compounds were pulverized, granulated and then dried in the same manners as in Procedures (4-1), except that the granules were subjected to dressing of grain so as to have a weight average particle-size within the range of 300 to 1000 μm. The resulting samples were denoted by (5-1) through (5-25), respectively.

Experiment (5-1)

From the resulting samples, 100 g each thereof were taken out twice. After each of the parts taken out was separately put in an opened schale and was then preserved for one hour in a room conditioned at 25° C. and 55 % RH, each of them was further aged for further one hour in a conditioning room at 35° C. and 45 % RH, respectively.

Every sample was evaluated on the blocking behavior due to moisture sorption based on the following criteria.

The results thereof will be shown in Table 5.

◎◎: Both had no blocking behavior at all,

◎: One of them had a blocking behavior, but it was produced in a very small part of the whole, and the blocking was immediately remedied by giving it a slight vibration, ○: Both had each a blocking behavior, but they were produced each in very small parts of the whole, and each blocking behavior was remedied by giving them a slight vibration, and X: Both had each a blocking behavior in about a half of the whole, and the blocking behavior could not be remedied even by giving them a slight vibration; provided that those evaluated by X are problematic when making a quantitatively supply.

TABLE 5

| Sample No. | Compound [C] | Mono-saccharide (amount added in wt %) | Polysaccharide (amount added in wt %) | Water-soluble polymer (amount added in wt %) | Blocking behavior | Re-marks |
|---|---|---|---|---|---|---|
| 5-1 | C-1 | — | — | — | ○ | Inv. |
| 5-2 | C-1 | B-69(2) | — | — | ◎◎ | Inv. |
| 5-3 | C-1 | B-74(2) | — | — | ◎◎ | Inv. |
| 5-4 | C-1 | B-76(2) | — | — | ◎◎ | Inv. |
| 5-5 | C-1 | — | Pine-Flow(2)*2 | — | ◎◎ | Inv. |
| 5-6 | C-1 | — | Pine-Dex 100(2)*2 | — | ◎ | Inv. |
| 5-7 | C-1 | — | Pine-Dex 3(2)*2 | — | ◎ | Inv. |
| 5-8 | C-1 | — | — | PEG#4000(2)*1 | ◎◎ | Inv. |
| 5-9 | C-1 | — | — | PEG#6000(2)*1 | ◎◎ | Inv. |
| 5-10 | C-3 | — | — | — | ○ | Inv. |
| 5-11 | C-3 | B-69(4) | — | — | ◎◎ | Inv. |
| 5-12 | C-3 | B-74(4) | — | — | ◎◎ | Inv. |
| 5-13 | C-3 | B-76(4) | — | — | ◎◎ | Inv. |
| 5-14 | C-3 | — | Pine-Flow(2)*2 | — | ◎◎ | Inv. |
| 5-15 | C-3 | — | Pine-Dex 100(2)*2 | — | ◎ | Inv. |
| 5-16 | C-3 | — | Pine-Dex 3(2)*2 | — | ◎ | Inv. |
| 5-17 | C-3 | — | — | PEG#4000(2)*1 | ◎◎ | Inv. |
| 5-18 | C-3 | — | — | PEG#6000(2)*1 | ◎◎ | Inv. |
| 5-19 | C-3 | B-76(0.5) | — | — | ◎ | Inv. |
| 5-20 | C-3 | B-76(1) | — | — | ◎◎ | Inv. |
| 5-21 | C-3 | B-76(8) | — | — | ◎◎ | Inv. |
| 5-22 | C-3 | B-76(10) | — | — | ◎◎ | Inv. |
| 5-23 | C-3 | B-76(15) | — | — | ◎◎ | Inv. |
| 5-24 | C-3 | B-76(20) | — | — | ◎ | Inv. |
| 5-25 | C-3 | B-76(2) | — | PEG#6000(2)*1 | ◎◎ | Inv. |

Inv.: Invention

*1Produced by Nihon Yushi Co.

*2Produced by Matsutani Chemical Industrial Co.

As is obvious from Table 5, color developing agent granules of the invention, which are capable of remarkably improving a blocking behavior after aging, can be provided when containing a saccharide and/or a water-soluble polymer therein.

It is also proved that the above-mentioned effect can further be enhanced when a saccharide and/or a water-soluble polymer are added in an amount within the range of 1.0 to 15 wt %.

Example 6

| | |
|---|---|
| Compound (C-1) | 15,000 g |

Granules (a) were prepared by pulverizing, granulating, grain-dressing and then drying the above-mentioned compound in the same manners as in Procedure (4-1).

Procedure (6-2 )

Granules (a') were prepared in the same manner as in Procedure (6-1), except that compound (C-1) was replaced by compound (C-3).

| Procedure (6-3) | |
|---|---|
| Compound (C-1) | 10,000 g |
| Disodium salt of compound (7) | 3,000 g |
| D-mannitol | 1,700 g |

Granules (a") were prepared by pulverizing, granulating, drying and then rectifying the above-mentioned compounds in the same manners as in Procedures (4-1).

Procedures (6-4)

Granules (a'") were prepared in the same manner as in Procedures (6-3), except that Exemplified compound (C-1) was replaced by (C-3).

Procedures (6-5)

Anhydrous potassium carbonate 15,000 g

In a room maintained at 30° C. and 50% RH, the above compound was pulverized up to have a particle-size of not larger than 100 μm in the same manner as in Procedure (4-1). The resulting compound was granulated by adding water as a binder, by making use of a stirring granulator.

The granulation was carried out for about 7 minutes while dropping 450 ml of water at the adding rate of 750 ml/min. The resulting granules were dried by a fluidized-bed dryer while controlling a hot-air temperature so as to keep it within the range of 50° to 65° C. and, besides, the dried granules were subjected to grain-dressing, in the same manner as in Procedures (4-1), to form the granules having a weight averaged particle-size within the range of 300 to 1000 μm. The resulting granules were denoted by (b).

| Procedure (6-6) | |
|---|---|
| Anhydrous sodium carbonate | 7,300 g |
| Anhydrous sodium sulfite | 80 g |
| Lithium hydroxide monohydrate | 800 g |
| Pentasodium diethylenetriamine pentaacetate | 720 g |
| Sodium paratoluenesulfonate | 3,000 g |
| Polyethylene glycol #4000, (produced by Nihon Yushi Co.) | 2,000 g |
| D-mannitol | 1,300 g |

By making use of the above-given compounds, granules (b') were prepared in the same manner as in Procedure (6-5), except that the amount of water added thereto was changed to be 750 ml.

| Procedure (6-7) | |
|---|---|
| Anhydrous potassium carbonate | 9,000 g |
| Anhydrous sodium sulfite | 1,400 g |
| Pentasodium diethylenetriamine pentaacetate | 580 g |
| Sodium paratoluenesulfonate | 2,000 g |
| Polyethylene glycol #6000, (produced by Nihon Yushi Co.) | 1,200 g |
| D-mannitol | 920 g |

Granules (b") were prepared by pulverizing, granulating and drying the above-given compounds in the same manner as in Procedure (6-5), except that the amount of water added thereto was changed to be 650 ml.

| Procedure (6-8) | |
|---|---|
| Hydroxyl amine sulfate | 12,000 g |
| Potassium bromide | 1,400 g |
| Disodium 1,2-dihydroxybenzene-3,5-disulfonate monohydrate | 700 g |
| Pine-Flow, (produced by Matsutani Chemical Industrial Co.) | 900 g |

Granules (d) were prepared by making use of the above-given compounds in the same manner as in Procedure (6-5), except that the amount of water added thereto was changed to 500 ml.

| Procedure (6-9) | |
|---|---|
| Disodium bis(sulfoethyl)hydroxyl amine | 4,000 g |
| Sodium paratoluenesulfonate | 9,000 g |
| Cinopar SFP (produced by Ciba Geigy AG.) | 1,500 g |
| Pine-Flow | 1,500 g |

Granule (d') were prepared by making use of the above-given compounds in the same manner as in Procedure (6-5), except that the amount of water added thereto was changed to be 1,200 ml.

Procedure (6-10)

Samples (6-1) through (6-8) were each prepared by mixing the granules prepared, respectively, in Procedure (6-1) through (6-9) by making use of a cross-rotary type mixer, at the mixing ratios shown in the following Table 5.

Experiment (6-1)

Under the same conditions as in Example 1, the color-tint evaluation were each tried on.

The results thereof will be shown in Table 5.

Experiment (6-2)

Fifty (50) grams each of Samples (6-1) through (6-8) were tightly packed in an aluminum packing material and then preserved for six (6) weeks under the following temperature conditions and the appearance of the samples were then evaluated, respectively.

<Preservation conditions>

(a) 60° C. for 4 hours, (b) 5° C. for 4 hours, (c) 20° C. for 4 hours, and (d) 40° C. for 4 hours.

Thereafter, (a) through (d) were repeated.

The results thereof will be shown in the following Table 6, provided that the evaluation criteria were equivalent to those applied to Example 1.

TABLE 6

| Sample No. | Granule (a) [Amount added (in wt %)] | Granule (b) [Amount added (in wt %)] | Granule (d) [Amount added (in wt %)] | Color-tint produced in open system | Color-tint produced in tightly closed system | Remarks |
|---|---|---|---|---|---|---|
| 6-1 | (a) (30) | (b) (70) | — | XX | X | Comparison |
| 6-2 | (a") (40) | (b) (60) | — | ◎ | ○ | Invention |
| 6-3 | (a") (25) | (b') (75) | — | ◎ | ◎ | Invention |
| 6-4 | (a") (20) | (b') (55) | (d') (25) | ◎ | ◎◎ | Invention |
| 6-5 | (a') (15) | (b) (85) | — | XX | X | Comparison |
| 6-6 | (a' ") (20) | (b) (80) | — | ◎ | ○ | Invention |
| 6-7 | (a' ") (15) | (b") (85) | — | ◎ | ◎ | Invention |
| 6-8 | (a' ") (15) | (b") (80) | (d) (5) | ◎ | ◎◎ | Invention |

As is obvious from Table 6, when a color developing agent granule of the invention contains a compound containing an alkali agent, there can provide a silver halide color photographic light-sensitive material capable of preventing not only the opened system but also the tightly closed system from being color-tinted.

Example 7

To each of the granules (see the following Tables 7 and 8) prepared in the same manner as in Examples 1 and 2, sodium myristoyl-N-methyl-β-alanine pulverized into a particle-size of not larger than 100 μm was added in an amount of 1.5 wt % of the total amount of the granules. The resulting mixtures were each mixed up for 3 minutes by making use of a cross-rotary type mixer.

The resulting mixtures were each continuously tableted by making use of a rotary type tableting machine that was a modified model of a Clean-Press Collect 18K so as to obtain about 3,000 tablets. At that time, the compression applied thereto was at 1200 kg/cm$^2$.

The tablets were prepared to be in the cylindrical shape. The diameter and filled amount were controlled as shown in Tables 7 and 8.

Experiment (7-1)

One of the resulting tablets was stored in an opened schale and the resulting color-tint produced thereon was evaluated, provided that the evaluation criteria were the same as in Example 5.

The results thereof will be shown in Tables 7 and 8.

Experiment (7-2)

There evaluated the adhesiveness to the tableting pestle observed when making a continuous tableting operation.

TABLE 7

| Sample No. | Sample used | Tablet size (in mm) | Tablet weight (in g) | Color-tint | Adhesiveness produced when tableting | Remarks |
|---|---|---|---|---|---|---|
| 7-1 | 1-1 | 10 | 0.5 | X | X | Comparison |
| 7-2 | 1-2 | 10 | 0.5 | Δ | X | Comparison |
| 7-3 | 1-3 | 10 | 0.5 | X | X | Comparison |
| 7-4 | 1-4 | 10 | 0.5 | X | X | Comparison |
| 7-5 | 1-16 | 10 | 0.5 | ⊙ | ⊙⊙ | Invention |
| 7-6 | 1-17 | 10 | 0.5 | ⊙ | ⊙⊙ | Invention |
| 7-7 | 1-18 | 10 | 0.5 | ⊙ | ⊙⊙ | Invention |
| 7-8 | 1-19 | 10 | 0.5 | ○ | ⊙ | Invention |
| 7-9 | 1-20 | 10 | 0.5 | ○ | ⊙ | Invention |
| 7-10 | 1-21 | 10 | 0.5 | ○ | ⊙ | Invention |
| 7-11 | 1-22 | 10 | 0.5 | X | ○ | Comparison |
| 7-12 | 2-1 | 20 | 3.5 | ⊙ | ⊙⊙ | Invention |
| 7-13 | 2-2 | 20 | 3.5 | ⊙ | ⊙⊙ | Invention |
| 7-14 | 2-3 | 20 | 3.5 | ○ | ⊙ | Invention |
| 7-15 | 2-4 | 20 | 3.5 | ○ | ⊙ | Invention |
| 7-16 | 2-5 | 20 | 3.5 | ○ | ⊙ | Invention |
| 7-17 | 2-6 | 20 | 3.5 | ○ | ⊙ | Invention |
| 7-18 | 2-7 | 20 | 3.5 | ○ | ⊙ | Invention |
| 7-19 | 2-8 | 20 | 3.5 | ○ | ○ | Invention |

TABLE 8

| Sample No. | No. of sample used | Tablet-size (in mm) | Weight of tablet (in g) | Color-tint | Adhesiveness produced when tableting | Remarks |
|---|---|---|---|---|---|---|
| 7-20 | 2-9 | 30 | 9.0 | ⊙ | ⊙⊙ | Invention |
| 7-21 | 2-10 | 30 | 9.0 | ⊙ | ⊙⊙ | Invention |
| 7-22 | 2-11 | 30 | 9.0 | ○ | ⊙ | Invention |
| 7-23 | 2-12 | 30 | 9.0 | ○ | ⊙ | Invention |
| 7-24 | 2-13 | 30 | 9.0 | ○ | ⊙ | Invention |
| 7-25 | 2-14 | 30 | 9.0 | ○ | ⊙ | Invention |
| 7-26 | 2-15 | 30 | 9.0 | ○ | ⊙ | Invention |
| 7-27 | 2-16 | 30 | 9.0 | ○ | ○ | Invention |
| 7-28 | 2-17 | 30 | 9.0 | ⊙ | ⊙ | Invention |
| 7-29 | 2-18 | 30 | 9.0 | ⊙ | ⊙ | Invention |
| 7-30 | 2-19 | 30 | 9.0 | ⊙ | ⊙ | Invention |
| 7-31 | 2-20 | 30 | 9.0 | ⊙ | ⊙ | Invention |
| 7-32 | 2-21 | 30 | 9.0 | ⊙ | ⊙ | Invention |
| 7-33 | 2-22 | 30 | 9.0 | ⊙ | ⊙ | Invention |
| 7-34 | 2-23 | 30 | 9.0 | Δ | X | Comparison |
| 7-35 | 2-24 | 30 | 9.0 | Δ | X | Comparison |

⊙⊙: Continuous tableting was completed without causing any problem

⊙: A few adhesion were produced just before the completion of tableting, but the tablet surface was flat and smooth without any problem, ○: At the time when tableting about 2,000 tablets, an adhesion to the tableting pestle was found, but the tablet surface was flat and smooth without any problem, and X: An adhesion to the tableting pestle was produced in the middle way of the tableting, so that the flat-and-smoothness of the tablet were lost.

As are obvious from Tables 7 and 8, when color developing chemical granules of the invention are compression-molded, there can provide tablet type solid processing chemicals having a high productivity, that is capable of not only preventing a color-tint produced in storage, but also remarkably reducing the adhesion to a tableting pestle when tableting the chemicals.

The effects of the invention can further be enhanced when making use of C-1 and C-3 each as a paraphenylenediamine compound and the disodium salts of (2) and (7) each as a compound represented by Formula [A].

Example 8

Cylindrical tablet-formed processing chemicals were prepared by making use of the granules prepared in the same manner as in Example 4 (see the following Table 9), except that the granules were made to have such a diameter and weight as shown in Table 9 in the same manner as in Example 7.

Experiment (8-1)

The resulting color-tints were evaluated in the same manner as in Example 7.

The results thereof will be shown in Table 9.

Experiment (8-2)

Two tablets each of the resulting tablets were taken out. One of them was placed so that the tablet surface compressed by a tableting pestle was in parallel to the floor. The other tablet was dropped from a 50 cm-height so as to hit the center of the former tablet. At that time, the latter tablet was so dropped as to hit the former tablet being allowed to stand still by the circumferential portion of the latter.

The results thereof will be shown in Table 9.

The evaluation thereof was made based on the following criteria.

◎◎: Both tablets had neither breakage nor crack,

◎: One of the tablets only had a crack, but the surface flat-and-smoothness thereof was within the tolerance limit, ○: Both tablets had each a crack, but the surface flat-and-smoothness thereof were each within the tolerance limit, Δ: Both tablets had a breakage and a crack, but the surface flat-and-smoothness thereof were within the tolerance limit, and X: Both tablets had a breakage and a crack and the surface flat-and-smoothness thereof were out of the tolerance limit.

As is obvious from Table 9, when compression-molding a granule prepared by adjusting the weight-averaged particle-size of color developing chemical granules of the invention to be within the range of 150 to 2000 μm, there can provide tablet type solid processing chemicals remarkably improved in color-tint and tablet breakage. A tablet breakage can further improved when the weight average particle-size is within the range of 150 to 1500 μm.

Example 9

Cylindrical tablet-formed solid processing chemicals were each prepared respectively by setting the granules prepared in the same manner as in Example 5 (See the following Table 10) so as to have such a size and a weight as shown in Table 10 in the same manner as in Example 7, provided that no control was applied at all during the tableting operations.

Experiment (9-1)

Among the resulting tablets, 20 pieces of any desired tablets were taken out. The weight thereof were measured and the weight variations were then evaluated.

The results thereof will be shown in Table 10.

The criteria of the evaluations for the fluctuation in weight were as follows.

◎◎: Every one of the 20 tablets were within the range of ±3% of the objective weight, ◎: Every one of the 20 tablets were within the range of ±4% of the objective weight, ○: Every one of the 20 tablets were within the range of ±5% of the objective weight, Δ: Every one of the 20 tablets were within the range of ±6% of the objective weight, and X: Some tables were out of the range of ±6% of the objective weight.

TABLE 9

| Sample No. | No. of sample used | Tablet-size (in mm) | Tablet weight (in g) | Color-tint | Breakage | Remarks |
|---|---|---|---|---|---|---|
| 8-1 | 4-1 | 15 | 1.0 | ○ | ◎◎ | Invention |
| 8-2 | 4-2 | 15 | 1.0 | ◎ | ◎◎ | Invention |
| 8-3 | 4-3 | 15 | 1.0 | ◎ | ◎◎ | Invention |
| 8-4 | 4-4 | 15 | 1.0 | ◎ | ◎◎ | Invention |
| 8-5 | 4-5 | 15 | 1.0 | ◎ | ◎◎ | Invention |
| 8-6 | 4-6 | 15 | 1.0 | ◎ | ◎◎ | Invention |
| 8-7 | 4-7 | 15 | 1.0 | ◎ | ◎ | Invention |
| 8-8 | 4-8 | 15 | 1.0 | ◎ | ◎ | Invention |
| 8-9 | 4-9 | 15 | 1.0 | ◎ | ○ | Invention |
| 8-10 | 4-10 | 15 | 1.0 | ○ | ◎◎ | Invention |
| 8-11 | 4-11 | 15 | 1.0 | ◎ | ◎◎ | Invention |
| 8-12 | 4-12 | 15 | 1.0 | ◎ | ◎◎ | Invention |
| 8-13 | 4-13 | 15 | 1.0 | ◎ | ◎◎ | Invention |
| 8-14 | 4-14 | 15 | 1.0 | ◎ | ◎◎ | Invention |
| 8-15 | 4-15 | 15 | 1.0 | ◎ | ◎◎ | Invention |
| 8-16 | 4-16 | 15 | 1.0 | ◎ | ◎ | Invention |
| 8-17 | 4-17 | 15 | 1.0 | ◎ | ◎ | Invention |
| 8-18 | 4-18 | 15 | 1.0 | ◎ | ○ | Invention |
| 8-19 | 4-19 | 15 | 1.0 | ◎◎ | ◎◎ | Invention |
| 8-20 | 4-20 | 15 | 1.0 | ◎◎ | ◎◎ | Invention |
| 8-21 | 4-21 | 15 | 1.0 | ◎◎ | ◎◎ | Invention |
| 8-22 | 4-22 | 15 | 1.0 | ◎◎ | ◎◎ | Invention |
| 8-23 | 4-23 | 15 | 1.0 | ◎◎ | ◎ | Invention |
| 8-24 | 4-24 | 15 | 1.0 | ◎◎ | ◎◎ | Invention |
| 8-25 | 4-25 | 15 | 1.0 | ◎◎ | ◎◎ | Invention |
| 8-26 | 4-26 | 15 | 1.0 | ◎◎ | ◎◎ | Invention |
| 8-27 | 4-27 | 15 | 1.0 | ◎◎ | ◎◎ | Invention |
| 8-28 | 4-28 | 15 | 1.0 | ◎◎ | ◎ | Invention |

TABLE 10

| Sample No. | No. of sample used | Tablet size (in mm) | Tablet weight (in g) | Weight fluctuation | Remarks |
|---|---|---|---|---|---|
| 9-1 | 5-1 | 30 | 10.0 | ○ | Invention |
| 9-2 | 5-2 | 30 | 10.0 | ◎◎ | Invention |
| 9 3 | 5-3 | 30 | 10.0 | ◎◎ | Invention |
| 9-4 | 5-4 | 30 | 10.0 | ◎◎ | Invention |
| 9-5 | 5-5 | 30 | 10.0 | ◎◎ | Invention |
| 9-6 | 5-6 | 30 | 10.0 | ◎ | Invention |
| 9-7 | 5-7 | 30 | 10.0 | ◎ | Invention |
| 9-8 | 5-8 | 30 | 10.0 | ◎◎ | Invention |
| 9-9 | 5-9 | 30 | 10.0 | ◎◎ | Invention |
| 9-10 | 5-10 | 30 | 10.0 | ○ | Invention |
| 9-11 | 5-11 | 30 | 10.0 | ◎◎ | Invention |
| 9-12 | 5-12 | 30 | 10.0 | ◎◎ | Invention |
| 9-13 | 5-13 | 30 | 10.0 | ◎◎ | Invention |
| 9-14 | 5-14 | 30 | 10.0 | ◎◎ | Invention |
| 9-15 | 5-15 | 30 | 10.0 | ◎ | Invention |
| 9-16 | 5-16 | 30 | 10.0 | ◎ | Invention |
| 9-17 | 5-17 | 30 | 10.0 | ◎◎ | Invention |
| 9-18 | 5-18 | 30 | 10.0 | ◎◎ | Invention |
| 9-19 | 5-19 | 30 | 10.0 | ◎ | Invention |
| 9-20 | 5-20 | 30 | 10.0 | ◎◎ | Invention |
| 9-21 | 5-21 | 30 | 10.0 | ◎◎ | Invention |
| 9-22 | 5-22 | 30 | 10.0 | ◎◎ | Invention |
| 9-23 | 5-23 | 30 | 10.0 | ◎◎ | Invention |
| 9-24 | 5-24 | 30 | 10.0 | ◎ | Invention |
| 9-25 | 5-25 | 30 | 10.0 | ◎◎ | Invention |

As is obvious from Table 10, when compression-molding color-developing chemical granules containing a saccharide and/or a water-soluble polymer, it can be proved that there can provide tablet form processing chemicals capable of performing a stable production having a few weight variations in the preparation process.

Example 10

Cylindrical tablet form processing chemicals were prepared respectively so as to have the granule-sizes and weight shown in Table 11 in the same manner as in Example 7, except that the amount of sodium myristoyl-N-methyl-β-alanine added to the granules (See Table 11) prepared in the same manner as in Example 6 was changed to 0.5 wt % of the total weight of the granules.

Experiment (10-1)

The color-tint evaluation was tried in the same manner as in Example 6.

The results thereof will be shown in Table 11.

Experiment (10-2)

The sizes of two (2) pieces each of the resulting tablets were measured. The tablets were put in the opened separate schales and were then preserved in a room conditioned at 30° C. and 45% RH for one hour. After then, they were further preserved in a room conditioned at 25° C. and 40% RH for 4 hours. Thereafter, the tablet-sizes were measured and the resulting expansion of each sample produced by the moisture sorption was evaluated.

The evaluation results will be shown in Table 11.

The criteria for the evaluation are as follows.

◎◎: Both tablets were expanded within the range of not more than 0.1% in the direction of the tablet-diameter obtained when tableting them, ◎: One of the tablets was expanded within the range of not more than 0.1% in the direction of tablet-diameter, and the other tablet expanded within the range of not more than 0.3%, ○: Both tablets were expanded in the direction of the tablet-diameter within the range of not more than 0.3%, and X: Both tablets were expanded by not less than 0.5%. The results thereof will be shown in Table 11.

TABLE 11

| Sample No. | No. of sample used | Tablet diameter (in mm) | Tablet weight (in g) | Color-tint in opened system | Expansion | Remarks |
|---|---|---|---|---|---|---|
| 10-1 | 6-1 | 30 | 11 | XX | X | Comparison |
| 10-2 | 6-2 | 30 | 11 | ◎ | ○ | Invention |
| 10-3 | 6-3 | 30 | 11 | ◎ | ◎ | Invention |
| 10-4 | 6-4 | 30 | 11 | ◎ | ◎◎ | Invention |
| 10-5 | 6-5 | 30 | 11 | XX | X | Comparison |
| 10-6 | 6-6 | 30 | 11 | ◎ | ○ | Invention |
| 10-7 | 6-7 | 30 | 11 | ◎ | ◎ | Invention |
| 10-8 | 6-8 | 30 | 11 | ◎ | ◎◎ | Invention |
| 10-9 | 6-4 | 15 | 1.5 | ◎ | ◎◎ | Invention |

TABLE 11-continued

| Sample No. | No. of sample used | Tablet diameter (in mm) | Tablet weight (in g) | Color-tint in opened system | Expansion | Remarks |
|---|---|---|---|---|---|---|
| 10-10 | 6-8 | 15 | 1.5 | ⊙ | ⊙⊙ | Invention |
| 10-11 | 6-4 | 10 | 0.7 | ⊙ | ⊙⊙ | Invention |
| 10-12 | 6-8 | 10 | 0.7 | ⊙ | ⊙⊙ | Invention |

As is obvious from the contents of Table 11, when carrying out the compression-molding after mixing a compound containing an alkali agent in a color-developing chemical granule of the invention, there can provide a tablet type processing chemical capable of not only preventing a color-tint production but also remarkably improving an expansion prevention of the granule.

What is claimed is:

1. A color developing composition in the form of granules for a silver halide color photographic material mainly containing a p-phenylenediamine compound, wherein said color developing composition contains a compound represented by the following formula (A) in an amount of 0.01 to 3.0 moles per mole of said p-phenylenediamine compound, said color developing composition exhibiting a pH of 5.0 or less when dissolved in water, and further containing a saccharide or water-soluble polymer in an amount of 1.0 to 15% by weight,

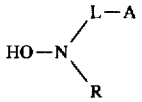

formula (A)

wherein L represents an alkylene group; A represents a carboxy group, sulfo group, phosphono group, phosphinic acid residue, hydroxy group, amino group, ammonio group, carbamoyl group, cyano group or sulfamoyl group; R represents a hydrogen atom or an alkyl group.

2. The color developing composition of claim 1, wherein a weight-averaged particle size of said color developing composition is from 150 to 2000 μm.

3. The color developing chemicals of claim 1, wherein said color developing composition contains the water soluble polymer.

4. A solid color developing composition, which comprises a mixture of the color developing composition as claimed in claim 1 and an alkali agent.

5. A color developing composition in a tablet form, wherein the tablet form composition is prepared by compression-molding the color developing composition as claimed in claim 1.

6. The color developing composition of claim 1, wherein a weight-averaged particle size of said color developing chemicals is from 150 to 2000 μm.

7. The color developing composition of claim 6, wherein a molar ratio of the compound represented by the formula (A) to the p-phenylenediamine compound is from 0.05 to 2.0.

8. The color developing composition of claim 6 further comprising an alkali agent.

9. The color developing chemicals of claim 8, wherein molar ratio of the compound represented by the formula (A) to the p-phenylenediamine compound is from 0.05 to 2.0.

* * * * *